US005161679A

United States Patent [19]

Russo

[11] Patent Number: 5,161,679

[45] Date of Patent: Nov. 10, 1992

[54] ELECTRICAL TRIGGER SWITCH WITH SAFETY FEATURES

[75] Inventor: Louis G. Russo, Marengo, Ill.

[73] Assignee: Guardian Electric Manufacturing Company, Woodstock, Ill.

[21] Appl. No.: 722,898

[22] Filed: Jun. 28, 1991

[51] Int. Cl.[5] ..... H01H 3/20; H01H 9/20

[52] U.S. Cl. ..... 200/43.17; 200/334; 200/1 B; 200/338; 200/522; 200/43.22; 200/293.1; 200/332.2

[58] Field of Search ..... 200/1 B, 43.01, 43.11, 200/43.22, 43.17, 43.16, 505, 522, 573, 293.1, 321, 322, 332, 332.2, 334, 335, 338, 337

[56] References Cited

U.S. PATENT DOCUMENTS

| | | | |
|---|---|---|---|
| 2,330,646 | 9/1943 | Voigt et al. . | |
| 2,348,393 | 5/1944 | Krieger . | |
| 2,422,755 | 6/1947 | Strother . | |
| 2,712,272 | 7/1955 | Trevaskis et al. . | |
| 2,747,057 | 5/1956 | Obszarny | 200/293.1 |
| 2,791,664 | 5/1957 | Rohacs . | |
| 3,142,227 | 7/1964 | Stringer . | |
| 3,198,922 | 8/1965 | Rohacs . | |
| 3,204,807 | 9/1965 | Ramsing . | |
| 4,276,459 | 6/1981 | Willett | 200/43.17 X |
| 4,399,340 | 8/1983 | Crandall et al. | 200/334 |

*Primary Examiner*—Ernest G. Cusick
*Attorney, Agent, or Firm*—Allegretti & Witcoff, Ltd.

[57] ABSTRACT

An electrical trigger switch for controlling current through a pair of main leads. The switch includes a guard, which physically protects the trigger button from being depressed accidentally, and also an electrical safety feature. Particularly in harsh environments, the mechanical protection afforded by the guard alone may be insufficient. The trigger button may be depressed unintentionally, causing accidental injury. Accordingly, the guard of the present invention includes an electrical safety switch. The safety switch moves from a safety state to an enable state only when the guard is pivoted upward to an armed position. Unless the guard is so pivoted and the safety switch is placed in an enable state, the safety switch will stay in a safety state, disabling the trigger button, even if the trigger button is depressed.

8 Claims, 3 Drawing Sheets

ELECTRICAL TRIGGER SWITCH WITH SAFETY FEATURES

BACKGROUND OF THE INVENTION

The present invention relates generally to electrical switches and, more particularly, to an electrical trigger switch with both mechanical and electrical safety features. Many types of equipment include a manual control (such as a "joy stick") for an operator to signal the equipment to operate in a particular manner. Such controls often include an electrical trigger switch. When depressed, the trigger switch allows current to flow from one main lead to another and thus activate machinery to perform in a particular manner.

In many applications, it is particularly important that the trigger not be depressed accidentally. In such cases, the trigger switch may be fitted with a stiff spring to resist low pressure accidentally applied to the trigger. In other applications, including, for example, aircraft, trigger switches may also include a finger guard. The guard may pivot away from the trigger (in an "armed" position), to allow the trigger to be depressed. Alternatively, the guard may pivot to a position substantially adjacent the trigger (in a "guard" position), to physically block anything from coming in contact with the trigger, thus preventing the trigger from being accidentally depressed and activating the machinery.

Unfortunately, mechanical trigger guards may not always achieve their purpose. In particular, instances of guard failure may occur where the machinery and controls are subjected to physical punishment or other harsh environments. Also, the guard may fail a due to age or improper assembly.

For example, the trigger guard may be may break off about the pivot point and thereafter provide no protective structure for the trigger. Also, the guard may accidentally be pivoted to a position intermediate to the armed and guard positions. In such a case, where the guard is not closed all the way, a finger may be inserted in between the guard and the trigger, allowing the trigger to be depressed, even though the operator had previously intended to pivot the guard to the "guard" position.

SUMMARY OF THE INVENTION

In a principle aspect, the present invention is an electrical trigger switch. The switch controls the current through a pair of main leads and includes a trigger, a trigger guard, and a safety switch. The trigger defines both resting and activated positions. In one of the positions, the trigger interconnects the main leads, allowing current to flow from one lead to the other and activate a machine or other apparatus associated with the electrical trigger switch.

The trigger guard pivots between a guard position and an armed position. The guard position is substantially adjacent the trigger. In this position, the guard substantially resists physical pressure to move the trigger to an activated position. In the armed position, however, the trigger guard is substantially displaced from the trigger, allowing the trigger to easily be depressed and moved to the activated position manually.

The safety switch defines "safety" and "enable" states and is mechanically linked to the trigger guard. The safety switch changes from the safety state to the enable state when the trigger guard pivots from the guard position to the armed position. When in the enable state, the safety switch allows the trigger to selectively interconnect the main leads when the trigger is moved to the activated position. If the safety switch is in a safety state, however, the trigger cannot selectively interconnect the main leads even if the trigger is moved from the rest to the activated position.

Thus, an object of the present invention is an improved electrical trigger switch for controlling current through a pair of main leads. A further object is a safer electrical trigger switch that integrates both electrical and mechanical safety features.

Yet a further object of the present invention is an electrical trigger switch that is more compact. A further objective is an improved trigger switch that has a smaller parts count and that is more reliable. Yet still another object of the present invention is an improved trigger switch that is less expensive to manufacture. These and other objects, features, and advantages of the present invention are discussed or apparent in the following detailed description.

BRIEF DESCRIPTION OF THE DRAWING

A preferred embodiment of the present invention is described herein with reference to the drawing wherein.

DETAILED DESCRIPTION OF THE PREFERRED EMBODIMENT

Figure 1:
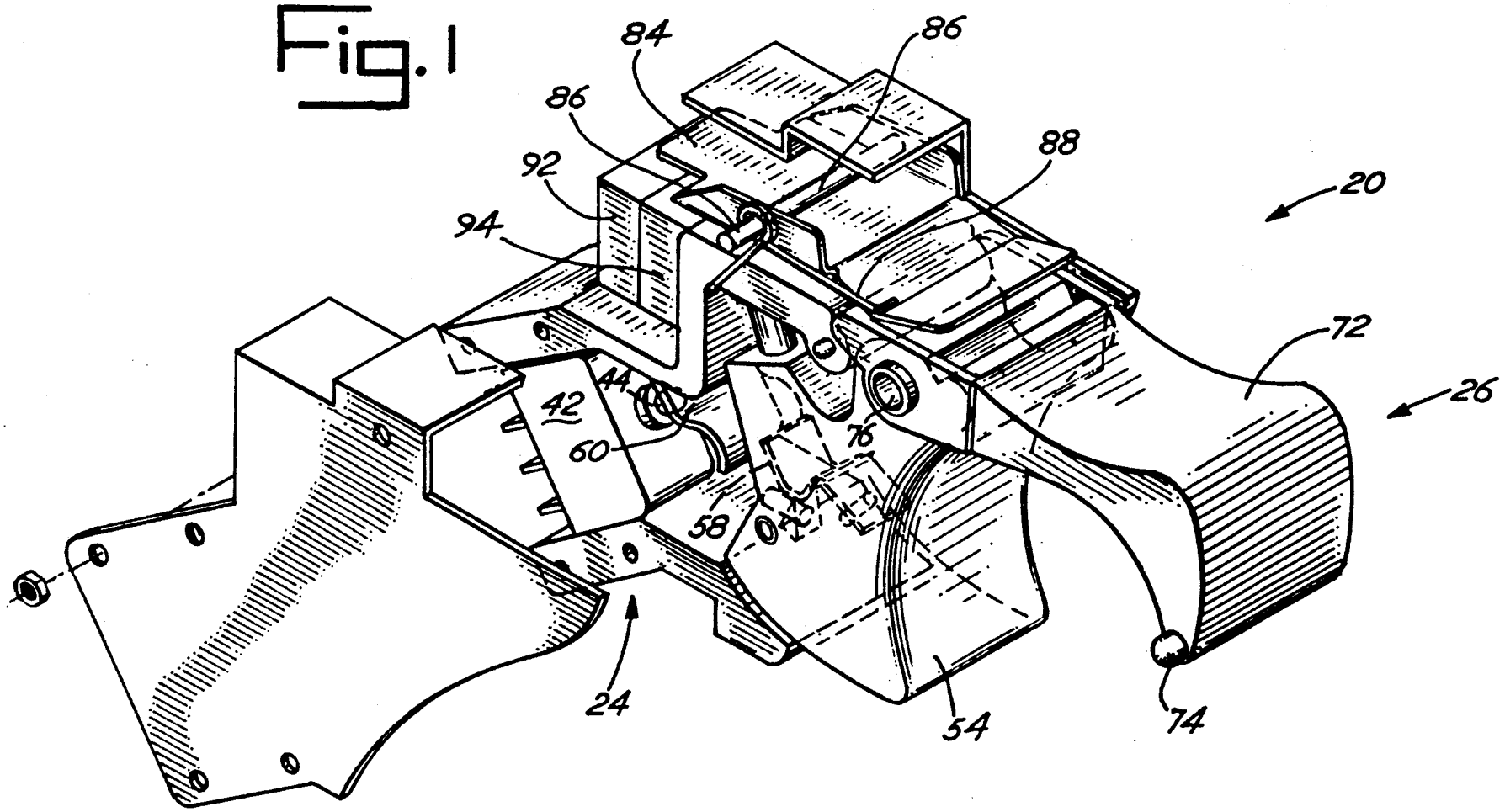
FIG. 1 is an isometric, partially exploded view of the preferred embodiment.

Referring to FIGS. 1–10, a preferred embodiment in the present invention is shown as an electrical trigger switch 20. As shown in FIGS. 1–7, the trigger switch 20 includes a housing 22, primary switch assembly 24, trigger guard 26, and safety switch assembly 28. The trigger switch 20 is interconnected to main leads 30.

The housing 22 holds the trigger switch 20 together. It may be mechanically attached to a joy stick or other manual control.

The primary switch assembly 24 includes both four sets of primary switches 32, 34, 36, 38 and a trigger assembly 40. See FIGS. 6–8. The switches 32–38 are fixed to the housing 22. An exemplary switch 38 is described below for purposes of illustration regarding the structure and operation of the other switches found within the trigger switch 20.

The switch 38 is a sub-miniature, double-break, snap-action switch having a housing 42 and an activating button 44. See FIG. 6. Depressing the activating button 44 changes the position of electrical contacts (not shown) within the housing 42 of the switch 38.

The sub-miniature switch 38 is interconnected to first, second, third and fourth leads 46, 48, 50, 52. See FIGS. 6, 8, and 9. While in a rest state, with the button 44 extended, a first set of leads is interconnected, such that current can flow from the first lead 46 to the second lead 48. See FIG. 9. Upon depressing the button 44, however, current flows between the third and fourth leads 50, 52 (and not between the first and second leads 46, 48). Thus, upon depression of the button 44 of the sub-miniature switch 38, machinery or other equipment that is activated by current flowing through the first and second leads 46, 48 is discontinued, while equipment that is activated by current flowing through the third and fourth leads 50, 52 is activated.

All four sub-miniature switches 32–38 are connected in a substantially parallel configuration. The switches 32–38 could be configured, for example, to "make" and "break" conduction paths for four different sets of machinery. In the preferred embodiment, however, all four switches 32–38 are wired in a parallel electrical configuration, such that if one, two, or even three of the switches 32–38 fails to operate, the fourth switch will still allow the trigger switch 20 to work. When the button 44 of the primary switch 38 is extended, the switch in the present embodiment is in a first, or open, state. When the button 44 is depressed, the switch 38 changes to a closed state.

Figure 5:
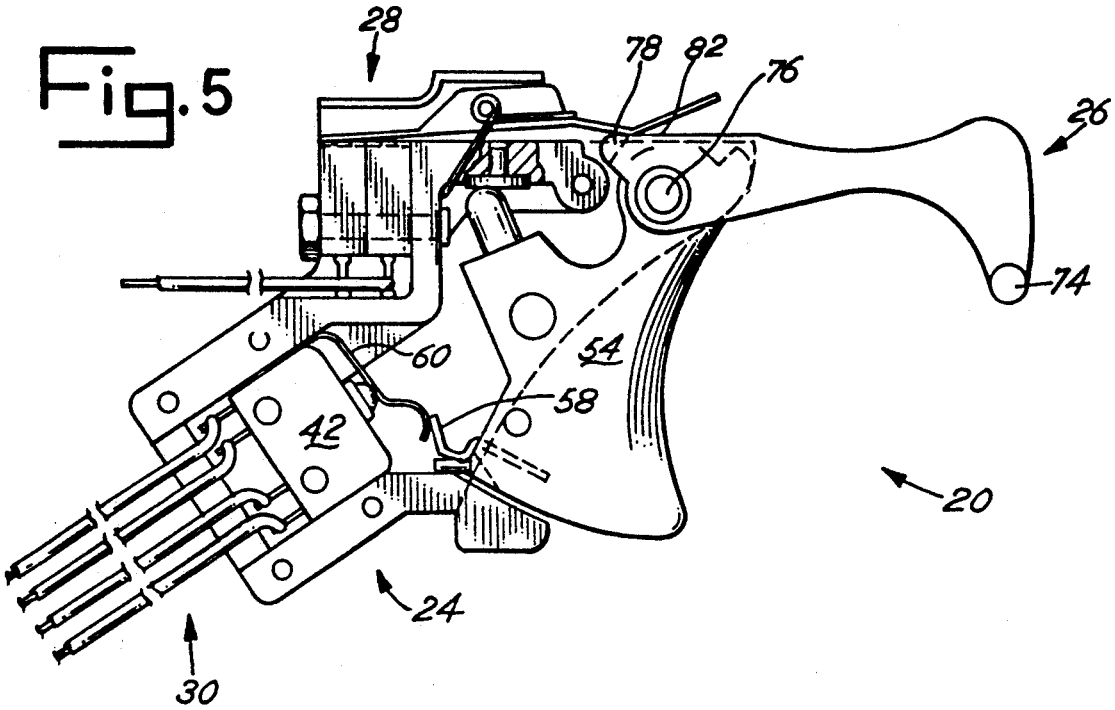
FIG. 5 is a side, partial cross-sectional view of the preferred embodiment shown in FIG. 2.
Figure 6:
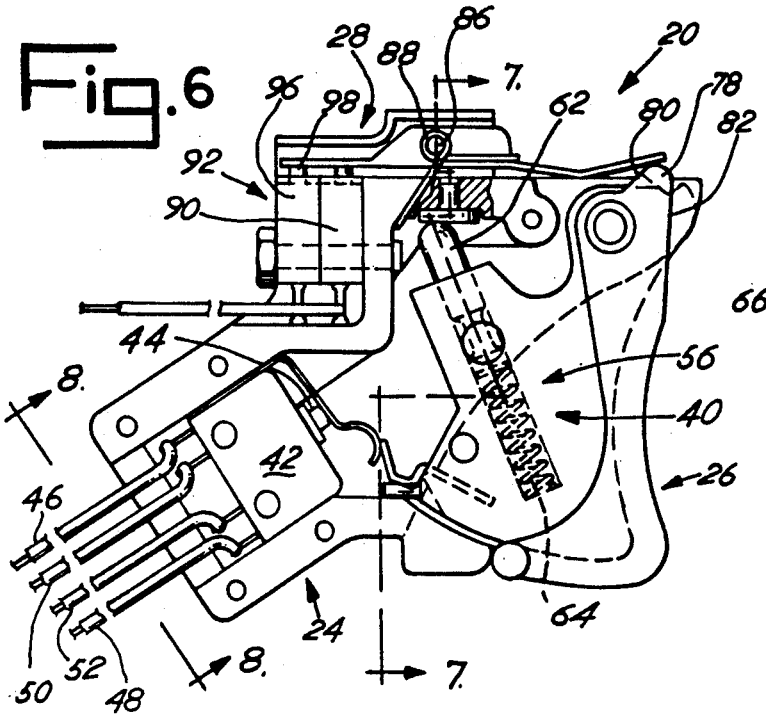
FIG. 6 is a side, partial cross-sectional view of the preferred embodiment shown in FIG. 3.
Figure 7:
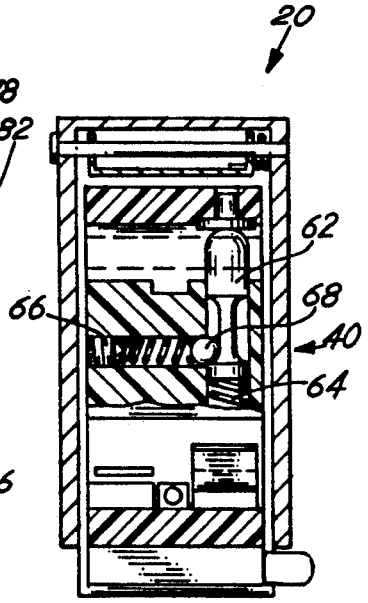
FIG. 7 is a cross-sectional view of the preferred embodiment shown in FIG. 6, taken along line 7—7.
Figure 8:
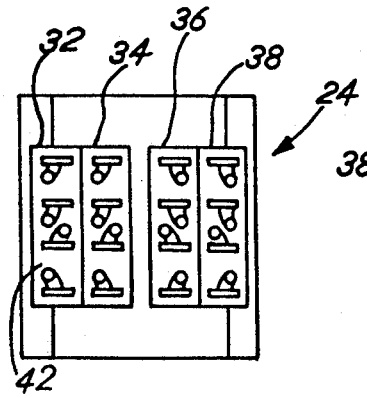
FIG. 8 is a cross-sectional view of the preferred embodiment shown in FIG. 6, taken along line 8—8.
Figure 9:
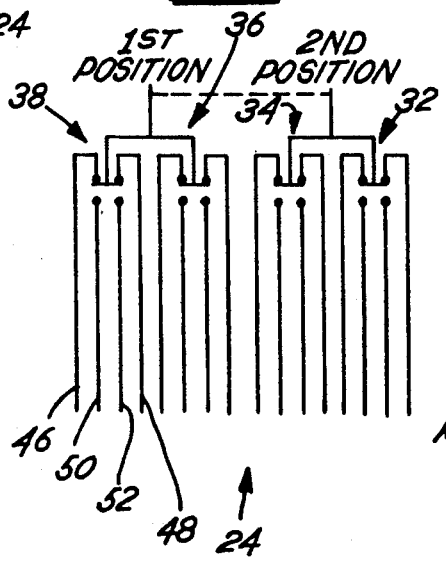
FIG. 9 is a schematic diagram of the primary switches of the preferred embodiment shown in FIG. 1.

As shown in FIGS. 5 and 6, the trigger assembly 40 includes a trigger button 54 pivotally connected to the housing 22, trigger operating assembly 56, and first and second actuating arms 58, 60. When the trigger button 54 is depressed, as shown in FIG. 5, the first actuating arm 58, interconnected to the trigger button 54, pushes against the second actuating arm 60. The second actuating arm 60 is interconnected to the housing 22 and flexibly extends over the button 44 of the sub-miniature switch 38 (as well as the buttons of the other sub-miniature switches 32–36). When the trigger is button 54 is manually depressed, the first arm 58 moves against the second arm 60, depressing the button 44 of the sub-miniature switch 38.

The trigger operating assembly 56 includes a contoured pin 62, first and second expanding springs 64, 66, and a ball bearing 68. Movement of the trigger button 54 inward is resisted, since movement of the trigger button 54 pushes the contoured pin 62 against the first expanding spring 64. The force required to depress the trigger button 54 is varied with the position of the trigger button 54, as the second expanding spring 66 presses the bearing 68 against the contoured pin 62.

Figure 2:
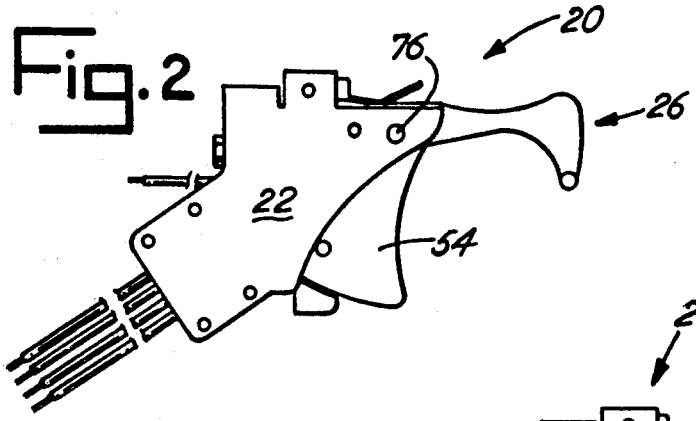
FIG. 2 is a side view of the preferred embodiment shown in FIG. 1, with the trigger guard pivoted to an armed position.
Figure 3:
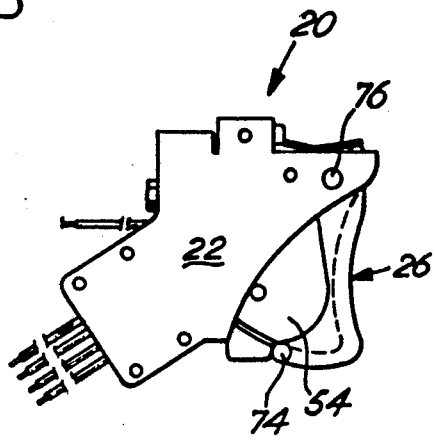
FIG. 3 is a side view of the preferred embodiment shown in FIG. 1, with the trigger guard pivoted to a guard position.

The trigger button 54 defines a first, or resting position, as shown in FIGS. 3 and 6, and a second, or armed position, as shown in FIGS. 2 and 5. In FIG. 5, the trigger button 54 has been depressed, moving it from a resting to an activated position, wherein the button 44 of the sub-miniature switch 38 (and the buttons of the other switches 32–36 as well) are depressed by movement of the actuating arms 58, 60.

Figure 4:
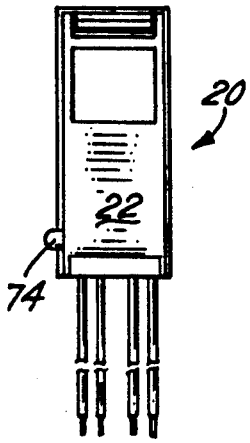
FIG. 4 is a front view of the preferred embodiment shown in FIG. 1.

The trigger guard 26 a includes a solid frontal portion 72, as shown in FIG. 4, an extension 74, a pivot bushing 76, a cam 78, and first and second mating surfaces 80, 82. The extension 74 aids in manually moving the guard 26 from a guard position, as shown in FIGS. 3 and 6, and to an armed position, as shown in FIGS. 2 and 5. The guard pivots around the pivot bushing 76.

Figure 10:
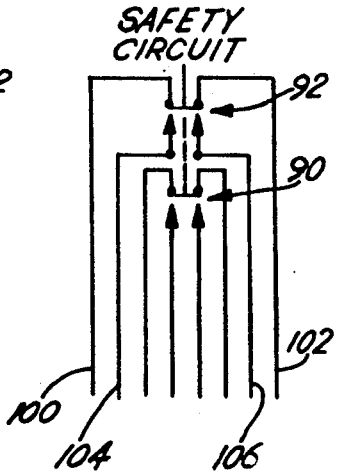
FIG. 10 is a schematic diagram of the safety switches of the preferred embodiment shown in FIG. 1.

The safety switch assembly 28 includes a pivoting actuating arm 84, pivot pin 86, pivoting spring 88, and two safety switches 90, 92. The two switches 90, 92 are in a parallel configuration, as shown in FIGS. 1, 6, and 10. Again, only one switch 92 is a explained below for exemplary purposes, and the description is equally applicable to the other switch 90.

The sub-miniature switch 92 includes a housing 96 and an extended button 98 which, when depressed, breaks contacts between first and second 100, 102 leads and makes contacts between third and fourth leads 104, 106. The button 98 of the subminiature 92 switch rests against the pivoting actuating arm 84. The actuating arm 84 is flexibly held against the switch 92 by the cam 78.

The first and second mating surfaces 80, 82 are on either side of the cam 78. When in the guard position, the first mating surface 80 rests against the actuating arm 84, and the pivoting spring 88 flexibly pushes against the first mating surface 80 and cam 78 to maintain the frontal portion 72 of the guard 26 in a substantially locked guard position adjacent the trigger button 54. This physically prevents the trigger button 54 from being pushed. In the guard position, shown in FIG. 6, the actuating arm 84 does not press upon the safety switch button 98. The spring 88 is used to provide extra force to ensure the position of the trigger guard-open or closed. It bears down on the cam side only.

When the guard 26 is pivoted to an armed state, as shown FIGS. 1, 2 and 5, the cam 78 and second mating surface 82 press against the actuating arm 84. The pressure exerted by the cam 78 against the actuating arm 84 pivots the actuating arm 84 downward, depressing the button 98 of the safety switch 92.

In the present embodiment, unless at least one of the safety switches 90, 92 has a button depressed, the operation of the first, second, third, and fourth primary trigger switches 32–38 is nullified. Thus, when the button 98 is in the extended position, as shown in FIG. 6, the first, second, third and fourth trigger switches 32–38 are effectively "short circuited," such that the trigger switch 20 will not function.

However, when the guard 26 is pivoted downward to a guard position, the actuating arm 84 rests against the first mating surface 80 of the guard (as shown in FIGS. 3 and 6) and the button 98 of the safety switch 92 is extended. If, for example, the trigger guard 26 were in the guard position but the trigger button 54 was nonetheless improperly depressed, the equipment associated with the trigger switch 20 would be unaffected until at least one of the safety switch buttons becomes depressed, as shown in FIG. 5.

The pivot pin 86 allows the actuating arm 84 to rock between first and second positions. As shown in FIG. 6, the actuating arm 84 is in a first position wherein the safety switch buttons are extended. The primary switch 38 can then connect the third and fourth leads 50, 52 only if the actuating arm 84 is rocked to a second position by the pivoting of the guard 26, as shown in FIGS. 1 and 5, which causes the buttons of the safety switches 90, 92 to be depressed. In such a condition, movement of the trigger button 54 will change the state of the primary switches 32–38.

Thus, the safety switches 90, 92 are mechanically linked to the trigger guard 26. The safety switches 90, 92 move from a safety state to an enable state upon the pivoting of the trigger guard 26 and the rocking of the actuating arm 84 held in tension by the pivoting spring 88.

The safety switches 90, 92 are electrically linked to the main leads 46–52 and primary switches 32–38 to enable the primary switches to selectively interconnect the main leads 46–52 only if the safety switches 90, 92 are in the enable state, as shown in FIG. 5. The safety switch 92 reaches the safety state because of the pivoting of the trigger guard 26, the resultant rocking of the actuating arm 84, and the resultant depression of the button 98 of the sub-miniature safety switch 92.

A preferred embodiment of the present invention has been described herein. It is to be understood, of course, that changes and modifications may be made in the embodiment preferred embodiment without departing from the true scope and spirit of the present invention, as defined by the appended claims.

What is claimed is:

1. An electric trigger switch for controlling current through a pair of main leads comprising:

a trigger movable between resting and activated positions, said trigger selectively interconnecting said pair of main leads upon moving between said resting and activated positions;

a trigger guard for pivoting between a guard position and an armed position, said guard position being substantially adjacent said trigger button to resist pressure to move said trigger, said armed position being substantially displaced from said trigger to allow said trigger to be expressed; and a safety switch defining safety and enable states, said safety switch being mechanically linked to said trigger guard and changing from said safety state to said enable state upon pivoting of said trigger guard from said guard position to said armed position, said safety switch in said enable state enabling said trigger to selectively interconnected said pair of main leads.

2. A trigger switch as claimed in claim 1 wherein said trigger includes a primary switch defining open and closed states, said primary switch selectively interconnecting said pair of main leads in one of said states upon movement of said trigger between resting and activated positions.

3. A trigger switch as claimed in claim 2 wherein said primary switch includes two tandem switches in a parallel configuration and said trigger changes said states of both said tandem switches upon moving to said activated position, whereby the two tandem switches provide for continued operation of said trigger switch in the event that one of said two tandem switches malfunctions.

4. A trigger switch as claimed in claim 1 wherein said safety switch comprises two tandem switches in a parallel configuration and said trigger guard changes said states of both of said tandem switches upon pivoting to said armed position, whereby said two tandem switches provide for continued operation of said safety switch in the event that one of said two tandem switches malfunctions.

5. A trigger switch as claimed in claim 1 further comprising spring means for urging said trigger toward said resting position.

6. A trigger switch as claimed in claim 1 wherein said trigger switch further comprises an actuator arm which pivots against said safety switch upon pivoting of said trigger guard to said armed position.

7. A trigger switch as claimed in claim 6 wherein said trigger guard includes a cam which rotates against said actuator arm when said trigger guard is pivoted.

8. A trigger switch as claimed in claim 7 wherein said actuator arm releasably holds said trigger guard in said guard and armed positions.

* * * * *